US008494189B2

(12) United States Patent
Katayama

(10) Patent No.: US 8,494,189 B2
(45) Date of Patent: Jul. 23, 2013

(54) VIRTUAL SOUND SOURCE LOCALIZATION APPARATUS

(75) Inventor: Masaki Katayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 802 days.

(21) Appl. No.: 12/271,289

(22) Filed: Nov. 14, 2008

(65) Prior Publication Data

US 2009/0123007 A1 May 14, 2009

(30) Foreign Application Priority Data

Nov. 14, 2007 (JP) ..... 2007-295637

(51) Int. Cl.
*H04R 5/02* (2006.01)
*H04R 5/00* (2006.01)

(52) U.S. Cl.
USPC ..... 381/303; 381/1; 381/17; 381/306

(58) Field of Classification Search
USPC ..... 381/1, 17, 303, 306
See application file for complete search history.

(56) References Cited

U.S. PATENT DOCUMENTS

| | | | | |
|---|---|---|---|---|
| 5,109,415 | A | 4/1992 | Ishida | |
| 5,799,094 | A | 8/1998 | Mouri | |
| 6,243,476 | B1 * | 6/2001 | Gardner | 381/303 |
| 7,113,609 | B1 * | 9/2006 | Neidich et al. | 381/305 |
| 8,170,245 | B2 | 5/2012 | Neidich et al. | |
| 2003/0086572 | A1 | 5/2003 | Sotome et al. | |
| 2005/0053249 | A1 * | 3/2005 | Wu et al. | 381/310 |
| 2006/0062410 | A1 | 3/2006 | Kim et al. | |
| 2006/0280323 | A1 | 12/2006 | Neidich et al. | |
| 2007/0154019 | A1 | 7/2007 | Kim | |

FOREIGN PATENT DOCUMENTS

| | | | |
|---|---|---|---|
| JP | 57-141500 | U | 9/1982 |
| JP | 2-140100 | A | 5/1990 |
| JP | 6-253399 | A | 9/1994 |
| JP | 8-265899 | A | 10/1996 |
| JP | 9-252499 | A | 9/1997 |
| JP | 2003-501918 | A | 1/2003 |
| JP | 2007-28134 | A | 2/2007 |
| JP | 2007-28198 | A | 2/2007 |

OTHER PUBLICATIONS

Extended European Search Report dated Feb. 22, 2013 (Seven pages).
Japanese Office Action dated Dec. 18, 2012 with English translation (seven pages).

* cited by examiner

*Primary Examiner* — S. V. Clark
*Assistant Examiner* — Jesse Y Miyoshi
(74) *Attorney, Agent, or Firm* — Crowell & Moring LLP

(57) ABSTRACT

In a virtual sound source localization apparatus, a distance between two loudspeakers and a shortest distance between a line connecting the loudspeakers and a listening position are set beforehand, and a listener operates an operating section to localize a Cch sound source at an approximately center of the loudspeakers, thereby adjusting a sound balance of the loudspeakers. In addition, a controller calculates a difference in distance from the loudspeakers to the listening position, sets a delay amount of delay correctors such that sound emitted from the loudspeakers substantially reaches the listening position simultaneously, and adjusts sound output timing of the loudspeakers. In this way, even though the listening position is changed, the listener can operate the operating section to optimize a virtual surround effect.

7 Claims, 8 Drawing Sheets

VIRTUAL SOUND SOURCE LOCALIZATION APPARATUS

BACKGROUND OF THE INVENTION

1. Technical Field

The present invention relates to a virtual sound source localization apparatus that localizes virtual sound sources around a listener.

2. Background Art

A virtual surround apparatus is known in which multi-channel audio signals are reproduced from two loudspeakers arranged in front of a listener to localize a plurality of virtual sound sources around the listener, thereby allowing the listener to feel a surround sense (a feeling of encirclement) as if a plurality of loudspeakers are arranged around the listener. In such an apparatus, virtual localization is imparted to the audio signals on the basis of head related transfer functions, but since a strict reproduction condition is applied, an optimum listening position where the listener feels the surround sense is limited. For this reason, if the listener changes a seat from the optimum listening position, the listener may not feel the surround sense. In the known apparatus, it is impossible to change the parameters in accordance with the position of the listener so as for the listener to feel the surround sense.

In order to solve this problem, an apparatus is suggested in which a position detection unit for detecting the position of the listener detects the position of the listener, and a coefficient (correction coefficient) based on the head related transfer functions is selected in accordance with a zone where the listener is located, thereby changing sound image localization (see Patent Document 1). In addition, an apparatus is suggested in which the position of the listener is detected by an impulse sound wave emitted from the loudspeaker and a microphone or a camera to measure a distance between the two loudspeakers and the head (ears) of the listener, and sound image localization is set on the basis of the distance (see Patent Document 2).

[Patent Document 1] JP-A-6-253399

[Patent Document 2] JP-A-2007-28134

In the known apparatus, however, it is necessary to set a plurality of correction coefficients at a certain position of the listener. In addition, a position detection unit, such as a camera or a microphone, for detecting the position of the listener is needed. For this reason, the structure or the operation of the apparatus becomes complicated.

Furthermore, as described above, if the listener changes a seat, he/she may not feel the surround sense. Accordingly, if a wide zone with a correction coefficient is set, the listener may not feel the surround sense at the end of the zone. If a narrow zone with a sound image localization coefficient is set, a plurality of sound image localization coefficients may be needed.

SUMMARY OF THE INVENTION

An object of the invention is to provide a virtual sound source localization apparatus that adjusts a sound image localization position in accordance with a listening position of a listener, thereby allowing the listener to feel a surround sense, without needing a position detection unit for detecting the position of the listener or a plurality of sound image localization coefficients.

To achieve the above-described object, the invention has the following aspects.

(1) According to an aspect of the invention, there is provided a virtual sound source localization apparatus, in which two loudspeakers for emitting sound of video/sound contents are arranged at front-left and front-right positions with respect to a default listening position, and multi-channel audio signals of the video/sound contents are supplied to the two loudspeakers, to thereby localize virtual sound sources around a listener at the default listening position. The apparatus includes: a virtual localization imparting unit that calculates transfer characteristics of sound reaching ears of the listener at the default listening position from a virtually localized position around the default listening position on the basis of predetermined head related transfer functions, and imparts the transfer characteristics to audio signals of channels to be localized as the virtual sound source; a crosstalk cancellation unit that performs crosstalk cancellation on the audio signals provided with the transfer characteristics to cancel crosstalk to the listener at the default listening position; an operating unit that receives an operation to localize a sound image, which is desired to be localized at an approximately center of the two loudspeakers at a new listening position different from the default listening position; a balance adjusting unit that performs balance adjustment on the signal levels of audio signals to be supplied to the two loudspeakers in accordance with the operation received by the operating unit to set sound of the sound image emitted from the two loudspeakers to be at the same volume level at the new listening position; and a first delay unit that calculates a difference in distance from the two loudspeakers to the new listening position in conjunction with the balance adjustment performed by the balance adjusting unit, delays a timing to supply the audio signals subjected to the crosstalk cancellation to the two loudspeakers on the basis of the difference in distance in order to change a timing, at which sounds emitted from the two loudspeakers reach to the new listening position, to the same as a timing, at which sounds emitted from the two loudspeakers reach the default listening position, and outputs the delayed audio signals to the balance adjusting unit.

With this structure, the two loudspeakers for emitting sound of the video/sound contents are arranged at the front-left and front-right positions with respect to the default listening position on the left and right sides of the monitor for displaying video of the video/sound contents. In the virtual sound source localization apparatus, when the listener is located at the new listening position different from the default listening position from the start or moves to the new listening position, the operating unit receives the operation to localize the sound image, which is desired to be localized at the center, toward the monitor at the approximately center of the two loudspeakers. Then, the balance adjusting unit adjusts the balance of the output levels of the two loudspeakers in accordance with the operation received by the operating unit, and sets sound of the sound image, which is desired to be localized at the center, emitted from the two loudspeakers to be at the same volume level at the new listening position. The delay unit calculates the difference in distance from the two loudspeakers to the new listening position, and delays the audio signal subjected to crosstalk cancellation on the basis of the difference in distance to change the timing, at which sounds emitted from the two loudspeakers reach the new listening position, to same as the timing, at which sounds emitted from the two loudspeakers reach the default listening position. With this adjustment, a timing at which sound is emitted from the two loudspeakers to the new listening position is adjusted, and thus sound reaches the new listening position at the same timing as the default listening position. If the video/sound contents is reproduced by the virtual sound source localization apparatus and the monitor, the listener turns the monitor, on which the video is displayed, and views the video. In this way, the sound emission timing or volume level is adjusted as if a loudspeaker close to the listener from among the two loudspeakers is arranged at the same distance as a loudspeaker far from the listener, and the virtual sound sources are moved in accordance with the listening position. For this reason, at the new listening position, crosstalk to the ears of the listener can be cancelled, and the virtual sound sources can be localized around the listener so as to have the same positional relationship as the virtually localized positions with respect to the default listening position. Therefore, even though the listener moves, the volume level and the amount of delay of sound are appropriately adjusted in accordance with the listening position. As a result, the listener can listen to multi-channel sound as if it is emitted from the virtual localized positions around the listener, and the listener can favorably feel a surround sense.

(2) The apparatus may further include an adding unit that adds the audio signal subjected to the crosstalk cancellation and another audio signal not subjected to the crosstalk cancellation, for each of the multi-channel audio signals. The first delay unit delays the added audio signal, instead of the audio signal subjected to crosstalk cancellation.

With this structure, in the virtual sound source localization apparatus, the multi-channel audio signals are added to each other, and then delayed and balance-adjusted. Therefore, the audio signals of all the channels are balance-adjusted and delayed. For this reason, the arrangement is virtually changed as if a loudspeaker close to the listener from among the two loudspeakers is at the same distance as a loudspeaker far from the listener, and the entire surround sound field is moved in accordance with the listening position. As a result, at the new listening position, the listener can favorably feel the surround sense.

(3) The apparatus may further include an adding unit that adds the audio signal subjected to the crosstalk cancellation and another audio signal not subjected to the crosstalk cancellation for each of the multi-channel audio signals. The balance adjusting unit performs the balance adjustment on the audio signal added by the adding unit, instead of the audio signal delayed by the first delay unit.

With this structure, in the virtual sound source localization apparatus, the audio signal of the channels subjected to crosstalk cancellation are delayed and then added to the other audio signal, and thus the audio signals of all the channels are balance-adjusted. Therefore, even though the listener moves to the new listening position, the listener can hear sound as if the virtual sound sources of the channels subjected to crosstalk cancellation can be heard by the listener are arranged to have the same positional relationship as the virtually localized positions set in accordance with the default listening position.

(4) The another audio signal not subjected to the crosstalk cancellation contains a front-channel audio signal. The apparatus further includes a second delay unit that delays a sound output timing to supply the front-channel audio signals to the two loudspeakers on the basis of the difference in distance calculated by the delay unit in order to cause sound based on the front-channel audio signals to be emitted from the virtually localized two loudspeakers.

With this structure, in the virtual sound source localization apparatus, the audio signal of the channels subjected to crosstalk cancellation and the audio signal of the front channels are delayed and then added to the another audio signals, and thus the audio signals of all the channels are balance-adjusted. Therefore, when the multi-channel is 5 ch, the audio signals of all the channels, excluding the center channel, are balance-adjusted and delayed. For this reason, the sound emission timing or volume level is changed as if a loudspeaker close to the listener from among the two loudspeakers is arranged at the same distance as a loudspeaker far from the listener, and the entire surround sound filed is moved in accordance with the listening position. As a result, the listener can feel the surround sense. In addition, the audio signal of the center channel is delayed, and thus the sound source of the center channel can be localized at the approximately center of the two loudspeakers.

(5) The apparatus may further include: an input unit that, as data to be used to calculate the difference in distance from the two loudspeakers to the new listening position, receives an input of information regarding a distance between the two loudspeakers and a shortest distance between a line connecting the two loudspeakers and the listening position; and a storage unit that stores the information received by the input unit. The first delay unit calculates the difference in distance by using the information read out from the storage unit and a difference in output level between the two loudspeakers after the balance adjustment performed by the balance adjusting unit.

With this structure, in the virtual sound source localization apparatus, if the input unit receives an input of information regarding the distance between the two loudspeakers and the shortest distance between the line connecting the two loudspeakers and the listening position, the storage unit stores the information. The delay unit reads out the information from the storage unit and calculates the difference in distance from the two loudspeakers to the listening position. Therefore, the listener inputs the distance between the two loudspeakers and the shortest distance between the line connecting the two loudspeakers and the listening position beforehand, and when the surround sense is not obtained, operates the operating unit to localize the audio signals of the channels subjected to crosstalk cancellation or different channels around the listener.

(6) The apparatus may further include: a monitor for displaying video of the video/sound contents, disposed between the two loudspeakers; a size storage unit that stores a size of the monitor, a distance between the two loudspeakers set according to the size, and a shortest distance between a line connecting the two loudspeakers and the listening position; and a size input unit that receives an input of the size of the monitor. The delay unit reads out information regarding the distance between the two loudspeakers according to the size of the monitor received by the size input unit and the shortest distance between the line connecting the two loudspeakers and the listening position from the size storage unit, and calculates the difference in distance by using the information and a difference in output level between the two loudspeakers after the balance adjustment performed by the balance adjusting unit.

In general, when video is displayed on a large monitor, and sound is reproduced by two loudspeakers, the distance between the two loudspeakers is substantially identical to the horizontal width of the monitor, and a listening distance is determined by an optimum viewing distance of the monitor. With this structure, in the virtual sound source localization apparatus, the size of the monitor for displaying video is input. The delay unit reads out the distance between the two loudspeakers according to the size of the monitor received by the input unit and the shortest distance between the line connecting the two loudspeakers and the listening position from the storage unit, and calculates the difference in distance by using the information and a distance in output level between the two loudspeakers balance-adjusted by the balance adjusting unit. Therefore, an input operation can be simplified, and it is possible to allow the listener to feel the surround sense in accordance with the operation of the operating unit by the listener, regardless of the listening position of the listener.

In the virtual sound source localization apparatus of the invention, a position detection unit for detecting the position of the listener or a plurality of correction coefficients are not needed, and the volume level (balance) and the delay amount are corrected depending on the listening position of the listener. Therefore, even though frequency characteristics according to an angle of the listening position with respect to the two loudspeakers are not corrected, the localized positions of the virtual sound sources can be adjusted, and thus the listener can sufficiently fee the surround sense.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

First Embodiment

Figure 1:
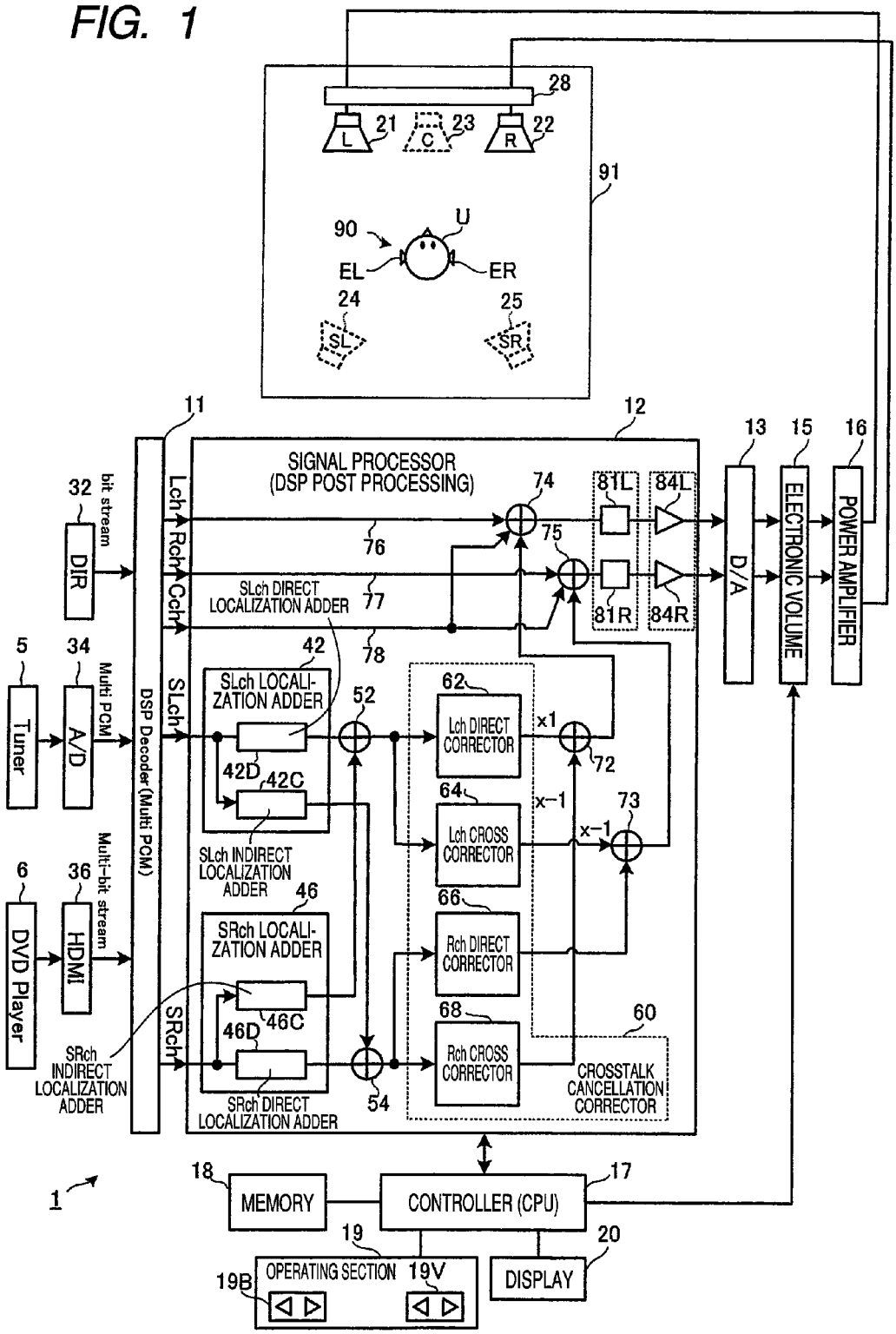
FIG. 1 is a block diagram showing the structure of a virtual sound source localization apparatus according to a first embodiment of the invention.

FIG. 1 is a block diagram showing the structure of a virtual sound source localization apparatus according to a first embodiment of the invention. It is assumed that a virtual sound source localization apparatus 1 shown in FIG. 1 reproduces surround sound of a 5-channel audio signal, which is an example of a multi-channel audio signal. FIG. 1 also shows a system structure in which a sound signal of video/sound contents, such as a television program or a movie, reproduced by a tuner 5 or a DVD player 6, is output to the virtual sound source localization apparatus 1, and a video signal of video/sound contents is output to a monitor 28. Then, the virtual sound source localization apparatus 1 emits virtual surround sound to a listener, and the monitor 28 displays video. In the following description, for the channels of the 5-channel audio signal, a front-left channel is denoted by L (Left) ch, a front-right channel is denoted by R (Right) ch, a center channel is denoted by C (Center) ch, a rear-left channel is denoted by SL (Surround Left) ch, and a rear-right channel is denoted by SR (Surround Right) ch.

The virtual sound source localization apparatus (hereinafter, simply referred to as a localization apparatus) 1 includes a DSP (Digital Signal Processor) decoder 11, a signal processor 12, a D/A converter 13, an electronic volume 15, a power amplifier 16, a controller 17, a memory 18, an operating section 19, and a display 20. An Lch loudspeaker 21 and an Rch loudspeaker 22 are connected to the power amplifier 16 of the localization apparatus 1. The Lch loudspeaker 21 and the Rch loudspeaker 22 are provided at front-left and front-right positions of the monitor 28, respectively.

As shown in FIG. 1, in a room 91, the Lch loudspeaker 21 is provided at a front-left position with respect to a listening position 90 of a listener U, and the Rch loudspeaker 22 is provided at a front-right position with respect to the listening position 90 of the listener U. The localization apparatus 1 localizes an SLch virtual sound source 24 at a rear-left position with respect to the listening position 90 of the listener U, localizes an SRch virtual sound source 25 at a rear-right position with respect to the listening position 90 of the listener U, and localizes a Cch sound image 23 at a front-center position with respect to the listening position 90 of the listener U.

A DIR (Digital audio Interface Receiver) 32, an A/D converter 34, and a digital interface, such as an HDMI (High Definition Multimedia Interface) (Registered Trademark) receiver 36 are connected to the DSP decoder 11. The DSP decoder 11 converts an analog sound signal or a digital bit stream, which is output from the tuner 5 through the A/D converter 34 or AV instrument, such as the DVD player 6, through the HDMI (Registered Trademark) receiver 36, into a 5-channel digital sound signal (PCM signal) and outputs the converted 5-channel digital sound signal to the signal processor 12. The DSP decoder 11 supports various data formats, and decodes an external input signal to a 5-channel digital audio signal (PCM signal) by using a decoder (not shown). When a 5-channel digital audio signal (PCM signal) is directly input from the DVD player 6, the DSP decoder 11 outputs the signal to the signal processor 12 as it is.

The signal processor 12 has an SLch localization adder 42 including an SLch direct localization adder 42D and an SLch indirect localization adder 42C, an SRch localization adder 46 including an SRch direct localization adder 46D and an SRch indirect localization adder 46C, adders 52 and 54, a crosstalk cancellation corrector 60 including an Lch direct corrector 62, an Lch cross corrector 64, an Rch direct corrector 66, and an Rch cross corrector 68, adders 72 to 75, delay correctors 81L and 81R, and level correctors 84L and 84R.

In the SLch localization adder 42, the SLch direct localization adder 42D sets a filter coefficient and a delay time based on head related transfer functions from the sound source localized at the rear-left position of the listener U to the left ear EL of the listener U. The SLch indirect localization adder 42C sets a filter coefficient and a delay time based on the head related transfer functions from the sound source localized at the rear-left position of the listener U to the right ear ER of the listener U. Meanwhile, in the SRch localization adder 46, the SRch direct localization adder 46D sets a filter coefficient and a delay time based on the head related transfer functions from the sound source localized at the rear-right position of the listener U to the right ear ER of the listener U. The SRch indirect localization adder 46C sets a filter coefficient and a delay time based on the head related transfer functions from the sound source localized at the rear-right position of the listener U to the left ear EL of the listener U.

In the invention, as the head related transfer functions used for setting the filter coefficients and the delay time in the SLch localization adder 42 and the SRch localization adder 46, a set of head related transfer functions having general versatility are used, regardless of a listener or a viewing distance and an acoustic environment. The details of the head related transfer functions will be described below.

As the head related transfer functions, for example, head related transfer functions corresponding to a substantially even head shape may be used.

The audio signals output from the SLch direct localization adder 42D and the SRch indirect localization adder 46C are added by the adder 52, and output to the Lch direct corrector 62 and the Lch cross corrector 64 of the crosstalk cancellation corrector 60.

The audio signals output from the SRch direct localization adder 46D and the SLch indirect localization adder 42C are added by the adder 54, and output to the Rch direct corrector 66 and the Rch cross corrector 68 of the crosstalk cancellation corrector 60.

It is assumed that a head related transfer function from the Lch loudspeaker 21 to the left ear EL of the listener U and a head related transfer function from the Rch loudspeaker 22 to the right ear ER of the listener U are fd. In addition, it is assumed that a head related transfer function from the Lch loudspeaker 21 to the right ear ER of the listener U and a head related transfer function from the Rch loudspeaker 22 to the left ear EL of the listener U are fc.

A filter coefficient corresponding to a reversed function of the head related transfer function from the Lch loudspeaker 21 to the left ear EL of the listener U is set in the Lch direct corrector 62. That is, a filter coefficient $fd/(fd^2-fc^2)$ is set in the Lch direct corrector 62. The Lch direct corrector 62 cancels a propagation property from the Lch loudspeaker 21 to the left ear EL for each of the channel audio signals output from the adder 52 so as for the listener U not to recognize that sound of each channel is emitted from the Lch loudspeaker 21. When sound of each channel is emitted from the Lch loudspeaker 21 and propagates to the left ear EL of the listener U, each frequency component is attenuated, but it is low-raised by the amount of attenuation in the Lch direct corrector 62. Accordingly, the SLch and SRch audio signals output from the Lch direct corrector 62 have the frequency characteristics imparted by the localization adders 42D and 46C and the frequency characteristics with the propagation property from the Lch loudspeaker 21 to the left ear EL cancelled.

A filter coefficient corresponding to a product of a reversed function of the head related transfer function from the Lch loudspeaker 21 to the left ear EL of the listener U and a reversed function of the head related transfer function from the Rch loudspeaker 22 to the right ear ER of the listener U is set in the Lch cross corrector 64. That is, a filter coefficient $fc/(fd^2-fc^2)$ is set in the Lch cross corrector 64. For the channel audio signals output from the adder 72, the Lch cross corrector 64 cancels a propagation property from the Lch loudspeaker 21 to the left ear EL and a propagation property from the Rch loudspeaker 22 to the right ear ER. The Lch cross corrector 64 performs the above-described processing on the channel audio signals output from the adder 52. Then, the audio signals are phase-inverted by a buffer (not shown), and are added by the adder 73. At this time, the output timings of the channel audio signals are adjusted such that a timing, at which an SLch added audio signal propagates to the right ear ER of the listener U after being emitted from the Rch loudspeaker 22, is identical to a timing, at which each channel audio signal propagates to the right ear ER of the listener U after being processed by the Lch direct corrector 62 and emitted from the Lch loudspeaker 21. Therefore, in the localization apparatus 1, sound for canceling sound, which is emitted from the Lch loudspeaker 21 and turns back to the right ear ER of the listener U is emitted from the Rch loudspeaker 22. As a result, it is possible to prevent sound, which is emitted from the Lch loudspeaker 21 and turns back to the right ear ER of the listener U, from being listened.

The Rch direct corrector 66 and the Rch cross corrector 68 perform the same processing as the Lch direct corrector 62 and the Lch cross corrector 64, respectively.

As such, sound of each channel emitted from the Lch loudspeaker 21 is listened only through the left ear EL of the listener U, and SLch and SRch sounds emitted from the Rch loudspeaker 22 are listened only through the right ear ER of the listener U. The SLch and SRch audio signals are given the frequency characteristics such that the sound sources are virtually localized at the rear-left and rear-right positions of the listener U. The channel audio signals emitted from the Lch loudspeaker 21 are given flat frequency characteristics so as for the listener U not to recognize that the audio signals are emitted from the Lch loudspeaker 21. The channel audio signals emitted from the Rch loudspeaker 22 are given flat frequency characteristics so as for the listener U not to recognize that the audio signals are emitted from the Rch loudspeaker 22. Therefore, the listener U can get a feeling of localization as if SLch and SRch sound is emitted from the virtual sound source virtually localized at the rear-left and rear-right positions of the listener U.

The adder 72 adds the audio signals, which are output from the Lch direct corrector 62, and the audio signals, which are output from the Rch cross corrector 68 and inverted (multiplied by −1) by the buffer (not shown), and outputs the added audio signals to the adder 74.

The adder 73 adds the audio signals, which are output from the Rch direct corrector 66, and the audio signals, which are output from the LCh cross corrector 64 and inverted (multiplied by −1) by the buffer (not shown), and outputs the added audio signals to the adder 75.

The adder 74 adds the Lch audio signals and the Cch audio signals output from the DSP decoder 11, and the audio signals output from the adder 72, and outputs the added audio signals to the D/A converter 13.

The adder 75 adds the Rch audio signals and the Cch audio signals output from the DSP decoder 11, and the audio signals output from the adder 73, and outputs the added audio signals to the D/A converter 13.

Here, two-divided (specifically, multiplied by 1/(2) Cch audio signals are input to the adders 74 and 75. Therefore, the Lch loudspeaker 21 and the Rch loudspeaker 22 emits Cch sound at the same volume, and thus the localization apparatus 1 allows the listener U to get a feeling of localization as if the Cch sound image 23 is localized at the center of the Lch loudspeaker 21 and the Rch loudspeaker 22.

The delay corrector 81L delays the audio signals output from the adder 74 in accordance with a delay amount set by the controller 17.

The delay corrector 81R delays the audio signals output from the adder 75 in accordance with a delay amount set by the controller 17.

The level corrector 84L adjusts the volume level of each of the audio signals output from the delay corrector 81L to a volume level default by the controller 17 in accordance with an operation of a balance adjusting button 19B of the operating section 19.

The level corrector 84R adjusts the volume level of each of the audio signals output from the delay corrector 81R to a volume level default by the controller 17 in accordance with an operation of the balance adjusting button 19B of the operating section 19.

The D/A converter 13 converts the digital audio signals of the five channels, that is, Lch, Rch, Cch, SLch, and SRch, output from the level correctors 84L and 84R of the signal processor 12 into analog audio signals.

The electronic volume 15 adjusts the signal amount of the analog sound signal of each channel on the basis of a control signal from the controller 17 in accordance with an operation by a volume adjusting button 19V of the operating section 19.

The power amplifier 16 amplifies the analog sound signals adjusted by the electronic volume 15 and outputs the amplified analog sound signals to the Lch loudspeaker 21 and the Rch loudspeaker 22.

The Lch loudspeaker 21 and the Rch loudspeaker 22 emit sound based on the analog sound signals output from the power amplifier 16.

The controller 17 controls the individual sections in accordance with an operation by the operating section 19. For example, if an operation to adjust a volume is performed by the operating section 19, the controller 17 outputs a control signal based on the corresponding operation to the electronic volume 15, to thereby change the volume of sound to be emitted from each of the loudspeakers 21 to 27. As the controller 17, a CPU or an MPU is preferably used. If the operating section 19 receives an input of information regarding a distance D between the loudspeakers or a listening distance H, the controller 17 controls the memory 18 to store the information.

The memory 18 stores programs which are executed by the controller 17, or input data which is received by the operating section 19.

The operating section 19 has the balance adjusting button 19B and the volume adjusting button 19V. A user inputs various operations and settings by the operating section 19 with respect to the localization apparatus 1. For example, the operating section 19 receives the distance D between the loudspeakers or the listening distance H. The balance adjusting button 19B adjusts a volume balance such that the center channel sound source is at the approximately center of the two loudspeakers 21 and 22. The volume adjusting button 19V adjusts the volume (signal amount) of the analog sound signal of each channel. The operating section 19 may be incorporated into a remote controller, such that the listener U may remote control the localization apparatus 1 at the listening position.

The display 20 displays a message from the localization apparatus 1 to the user.

In the localization apparatus 1 of this embodiment, with the above-described structure, if an operation of the balance adjusting button 19B of the operating section 19 is received, the sound balance (volume level) and the delay amount are changed depending on the position of the listener. Thus, a virtual surround effect is optimized such that the virtual sound sources are localized around the listener U, regardless of the listening position. That is, in the localization apparatus 1, if the multi-channel audio signal is input from the tuner 5 or the DVD player 6 to the signal processor 12 through the DIR 32, the A/D converter 34, or the DSP decoder 11, then the SLch localization adder 42 and the SRch localization adder 46 give virtual localization to the audio signals of the rear-left and rear-right channels. The crosstalk cancellation corrector 60 performs crosstalk cancellation. The adders 74 and 75 add the audio signals of the rear channels and other channels, and then multi-channel sound is emitted from the two loudspeakers 21 and 22 on the left and right sides in front of the listener U, such that a plurality of virtual sound sources are localized around the listener. In addition, in the virtual sound source localization apparatus, the distance between the two loudspeakers, and a shortest distance (optimum viewing distance) between the line connecting the two loudspeakers and the listening position are preset, and the listener operates the operating section 19 to localize the sound source of the center channel at the approximately center of the two loudspeakers. Thus, the sound balance of the two loudspeakers 21 and 22 is adjusted. The delay correctors 81L and 81R calculate a difference in distance from the two loudspeakers 21 and 22 to the listening position, and adjust sound output timings (delay amount) of the two loudspeakers 21 and 22 such that sounds emitted from the two loudspeakers 21 and 22 substantially reach the listening position simultaneously. Therefore, the volume level and delay amount of sound from the two loudspeakers 21 and 22 to the ears of the listener are adjusted to the same value, and as a result, crosstalk cancellation can be effectively performed.

In general, when crosstalk cancellation is performed, if the listening position of the listener U is changed, it is necessary to change the frequency characteristic in accordance with an angle of a loudspeaker with respect to the listening position. For this reason, in a known virtual surround apparatus, a plurality of correction coefficients are needed for correction of crosstalk cancellation.

When a person views video displayed on the monitor, if he/she turns toward the video, or when crosstalk occurs, if sound having a phase opposite to crosstalk phase at the substantially same volume level is emitted toward the ears of the listener at the listening position, crosstalk can be cancelled. Therefore, according to the invention, if a filter coefficient or delay time is prepared on the basis of a set of head related transfer functions, without needing a plurality of correction coefficients, the virtual sound sources can be localized, regardless of the listening position.

Specifically, according to the invention, the listener U operates the operating section 19 to adjust the balance of the volume level, such that sound, which is desired to be localized at a center, is localized at an approximately center of the two loudspeakers 21 and 22 (toward the monitor 28). Thus, the listener U listens to sounds emitted from the two loudspeakers 21 and 22 on the left and right sides at the substantially same volume level.

The level difference after balance adjustment is also converted into a delay difference, that is, a difference in distance from the two loudspeakers 21 and 22 to the listening position. The delay correctors 82L and 82R are adjusted on the basis of the delay difference, the loudspeakers are given the delay identical to that when a difference in distance from the two loudspeakers to a new listening position is same as a difference in distance from the two loudspeakers to a default listening position. That is, a timing at which sounds emitted from the two loudspeakers reach the new listening position is changed to the same as a timing at which sounds emitted from the two loudspeakers reach the default listening position. Sounds emitted from the two loudspeakers 21 and 22 are in opposite phase, such that crosstalk is cancelled at the default listening position. Meanwhile, as described above, since the sound emission timing is delayed to equalize the distance differences each other, sounds emitted from the two loudspeakers are in opposite phase at the new listening position. Therefore, at the new listening position, similarly to the default listening position, crosstalk cancellation can be performed with no problem.

In the invention, sound of the video/sound contents is reproduced by the virtual sound source localization apparatus 1, and video of the video/sound contents is displayed on the monitor 28. In this case, the listener (viewer) usually turns his/her face toward the screen of the monitor 28 in order to view the video (see FIG. 2G). For this reason, like the invention, if the volume level (gain) and delay amount of sound to be emitted from each two loudspeakers 21 and 22 is adjusted, even though the listener is shifted from the default listening position in front of the screen, the angle of the position of each loudspeaker and the face of the listener is substantially maintained. Therefore, only a set of head related transfer functions can be used, without needing a plurality of transfer characteristics in accordance with the listening position.

In the virtual sound source localization apparatus 1, the filter coefficient or delay time is set by using a set of head related transfer functions having general versatility. Therefore, even though the listener U turns toward the monitor 28, he/she feels the surround sense. That is, the face of the listener U is slightly shifted from the center of the two loudspeakers 21 and 22 (the center of the monitor 28), the listener U feels the surround sense with no problem.

Figure 2A:
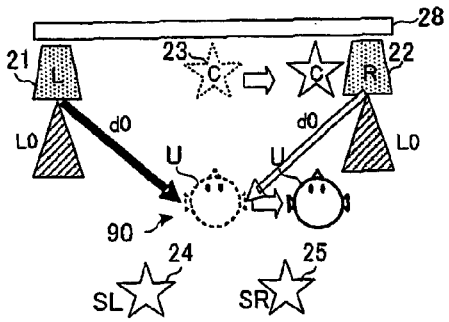
FIGS. 2A to 2H are diagrams illustrating an adjustment processing of a virtual surround effect according to a change of a listening position.

Specifically, the localization apparatus 1 performs a processing shown in FIGS. 2A to 2H. FIGS. 2A to 2H are diagrams illustrating an optimization processing a virtual surround effect according to a change of a listening position. In an initial state, as shown in FIG. 2A, the localization apparatus 1 sets such that the sound image 23 of the center channel is localized at the approximately center of the two loudspeakers 21 and 22 on the left and right sides. An optimum listening position where the listener U feels the surround sense is a center position of the two loudspeakers 21 and 22. The listening position of the listener U indicated by a dotted line of FIG. 2A is the default (default) listening position.

Figure 2B:
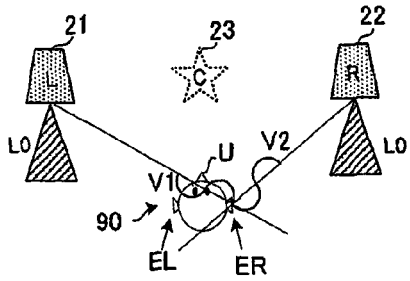

In this case, the distance from each of the loudspeakers 21 and 22 to the listening position 90 is d0. As shown in FIG. 2B, at the default listening position 90 of the listener U, sound V1 from the Lch loudspeaker 21 to the right ear ER of the listener U and sound V2 from the Rch loudspeaker 22 to the right ear ER in order to cancel the sound V1 are in opposite phase. The Lch loudspeaker 21 and the Rch loudspeaker 22 are at the same volume level L0. For this reason, the listener U listens to sounds emitted from the two loudspeakers 21 and 22 at substantially the same level, and crosstalk cancellation is effectively performed. Therefore, the sound V1 and the sound V2 are cancelled each other, and the sounds are not listened through the right ear ER of the listener U. Though not shown, the same is applied to the left ear EL of the listener U.

As shown in FIG. 2A, if the listener U moves from the listening position at the approximately center of the two loudspeakers 21 and 22 to a new listening position on the right side, the sound image 23 of the center channel is moved along with the listener U, and is then listened as if to be substantially located in front of listener U (front side).

Figure 2C:
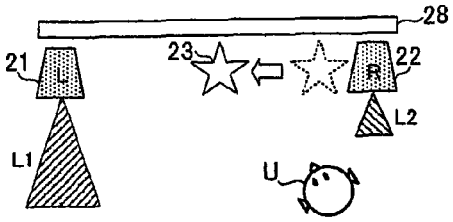

If the listener U moves from the default listening position to the new listening position or is located at the new listening position different from the default listening position from the start, and he/she does not feel the surround sense, the listener U conducts the following operation. That is, the listener U operates the balance adjusting button 19B of the operating section 19 to adjust the balance by using the level correctors 84L and 84R, such that the sound image 23 of the center channel is localized at the approximately center of the two loudspeakers 21 and 22. As shown in FIG. 2C, when the listener U moves from the center position of the two loudspeakers 2122 (default listening position 90) toward the Rch loudspeaker 22 (new listening position 90*n*), if an operation to localize the sound image 23 of the center channel at the approximately center of the two loudspeakers 21 and 22 is received by the balance adjusting button 19B of the operating section 19, the controller 17 outputs the control signal to the level correctors 84L and 84R, and adjust the volume level (balance adjustment) such that the volume of the Lch loudspeaker 21 is relatively turned up (L0→L1), and the volume of the Rch loudspeaker 22 is relatively turned down (L0 (L2).

Figure 2D:
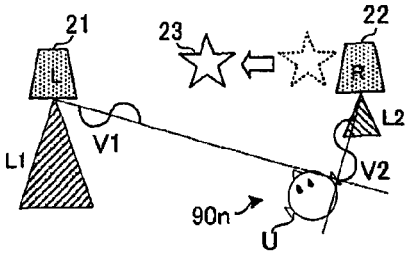

In this case, as shown in FIG. 2D, at the listening position 90*n* of the listener U, each wave of the sound V1 from the Lch loudspeaker 21 to the right ear ER of the listener U and the sound V2 from the Rch loudspeaker 22 to the right ear ER in order to cancel the sound V1 reaches the listening position 90*n* of the listener U at different timings. Meanwhile, as described above, since the volume levels are adjusted, the volume level of the Lch loudspeaker 21 is L1, and the volume level of the Rch loudspeaker 22 is L2. Therefore, the listener U listens to the sounds from the loudspeakers 21 and 22 at the substantially same volume level at the listening position 90*n*. As such, since the timings at which each wave of the sounds V1 and V2 reaches the wavefront are shifted from each other at the listening position 90*n*, crosstalk cancellation is not effectively performed, and the sounds V1 and V2 are listened through the right ear ER of the listener U. Though not shown, the same is applied to the left ear EL of the listener U.

Figure 2E:
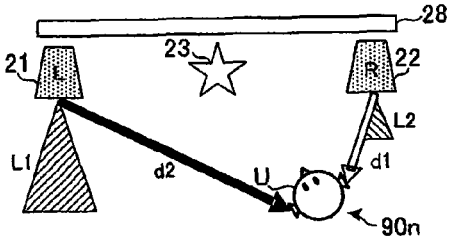
Figure 2F:
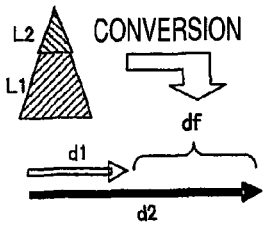

As shown in FIGS. 2E and 2F, the controller 17 converts the level difference after balance adjustment into the delay difference, that is, the difference in distance from the two loudspeakers 21 and 22 to the listening position 90 in connection with balance adjustment. Then, the delay correctors 82L and 82R are adjusted on the basis of the delay difference.

Figure 3A:
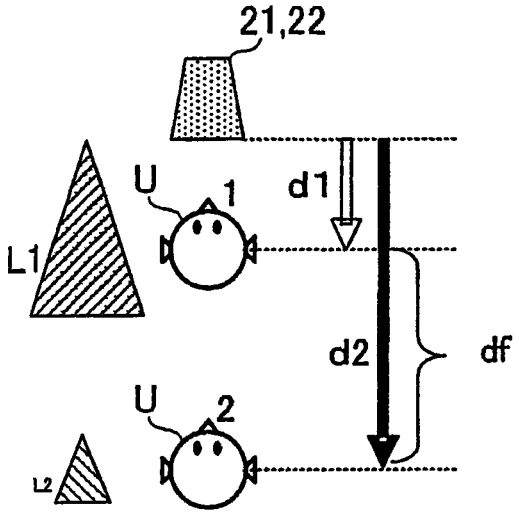
FIGS. 3A and 3B are diagrams illustrating a conversion procedure of a delay difference.
Figure 3B:
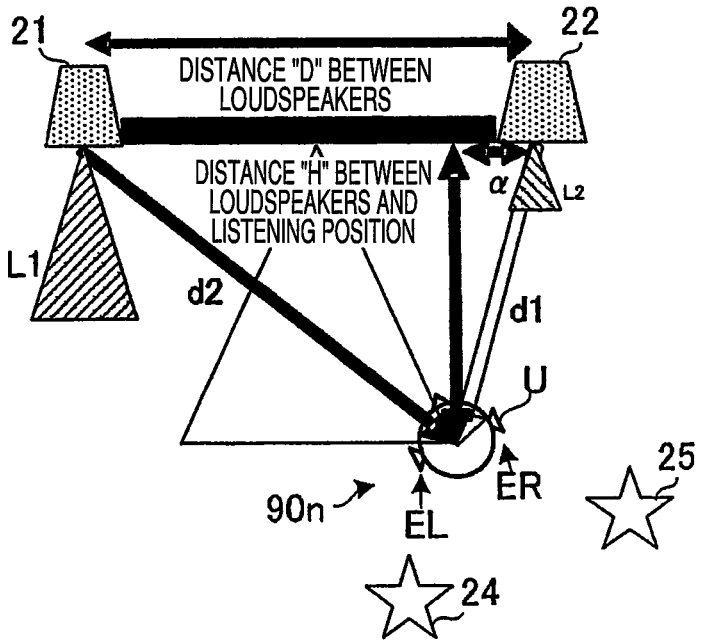

Specifically, the conversion of the delay difference is performed according to the following procedure. FIGS. 3A and 3B are diagrams illustrating a conversion procedure of a delay difference. As shown in FIG. 3A, let the volume level of the loudspeaker 21, the volume level of the loudspeaker 22, the distance from the loudspeaker 22 to the listening position 90, and the distance from the loudspeaker 21 to the listening position 90 be L1, L2, d1, and d2, respectively.

The relationship between the level difference and the distance is expressed by the following expression for distance attenuation.

$$L1-L2=20\log(d2/d1) \text{ where } d2/d1=10^{(L1-L2)/20)}=K \quad \text{(Expression 1)}$$

As shown in FIG. 3B, if the distance D between the loudspeakers 21 and 22, and the shortest distance (hereinafter, referred to as a listening distance) H between the line connecting the loudspeakers 21 and 22 and the listening position 90 are known, a listening displacement a is determined, and the distances d1 and d2 are geometrically expressed by the following expressions.

$$d1^2=H^2+\alpha^2 \quad \text{(Expression 2)}$$

$$d2^2=H^2+(D-\alpha)^2 \quad \text{(Expression 3)}$$

The controller 17 reads out the distance between the loudspeakers 21 and 22 and the listening distance H from the memory 18, determines α (>0) by Expressions 1 to 3, and calculates d1 and d2. Then, a distance difference df between d1 and d2 is calculated, and a delay difference is obtained by dividing the delay difference df by the sound velocity. The controller 17 adjusts the delay correctors 82L and 82R on the basis of the obtained delay difference.

Figure 2G:
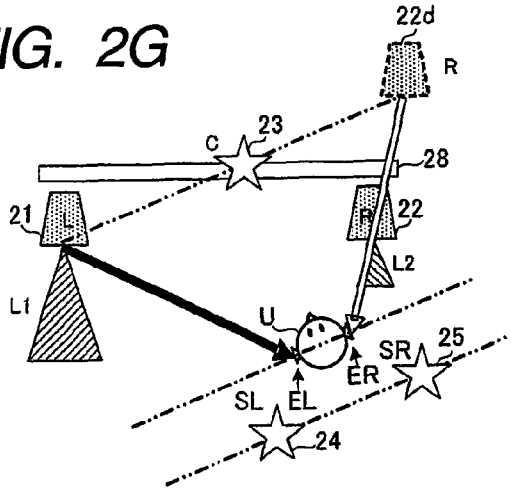

With this adjustment, a timing at which sounds emitted from the two loudspeakers reach the new listening position is changed to the same as a timing at which sounds emitted from the two loudspeakers reach the default listening position. Therefore, it is possible to move the entire surround sound field in accordance with the listening position of the listener U. That is, as shown in FIG. 2G, the listener U at the new listening position 90*n* listens to the sounds as if the loudspeaker 22 close to the listener U from among the two loudspeakers 21 and 22 is localized as an Rch loudspeaker 22*d* at the same distance as the loudspeaker 21 far from the listener U. The Cch sound image 23 is localized at the approximately center of the Lch loudspeaker 21 and the Rch loudspeaker 22*d*.

Figure 2H:
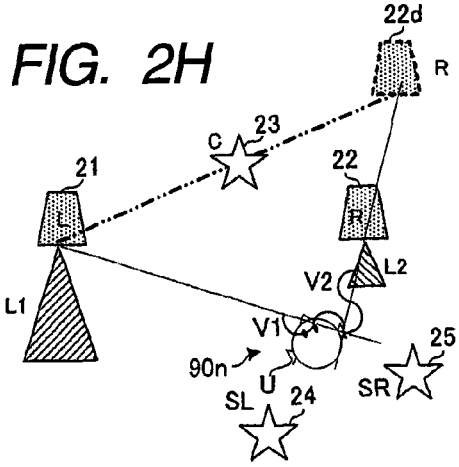

In this case, as shown in FIG. 2H, at the listening position 90*n* of the listener U, the sound V1 from the Lch loudspeaker 21 to the right ear ER of the listener U and the V2 from the Rch loudspeaker 22 (Rch loudspeaker 22*d*) to the right ear ER to cancel the sound V1 are in opposite phase. In addition, the volume level of the Lch loudspeaker 21 is L1, and the volume level of the Rch loudspeaker 22 is L2. Therefore, the listener U listens to the sounds from the loudspeakers 21 and 22 at the substantially same volume level at the listening position 90*n*. For this reason, at the listening position 90*n*, crosstalk cancellation is effectively performed, and the sounds V1 and V2 are cancelled each other. As a result, the sounds are not listened through the right ear ER of the listener U. Though not shown, the same is applied to the left ear EL of the listener U.

The listener U turns his/her face (head) toward the center of the monitor 28 in order to view video or image displayed on the screen of the monitor 28.

Therefore, the line connecting the Lch loudspeaker 21 and the Rch loudspeaker 22*d* is substantially parallel to a line connecting the ears EL and ER of the listener U. For this reason, the SLch and SRch virtual sound sources 24 and 25 are localized at rear-left and rear-right positions of the listener U where the line connecting the virtual sound sources 24 and 25 is substantially parallel to the line connecting the Lch loudspeaker 21 and the Rch loudspeaker 22*d*. As such, the sound sources and the virtual sound sources may be localized around the listener U, and as a result, the listener U can feel the surround sense.

Figure 4A:
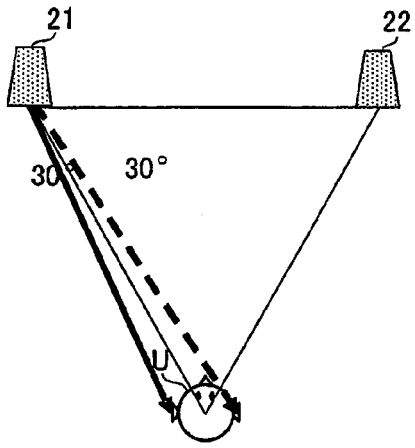
FIGS. 4A to 4C show a measurement result when a listening position is set at a center of two loudspeakers.
Figure 4B:
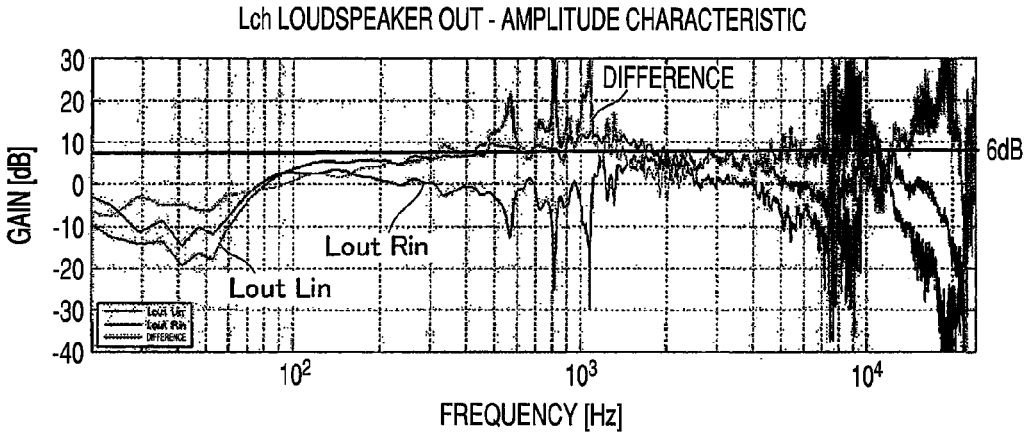
Figure 4C:
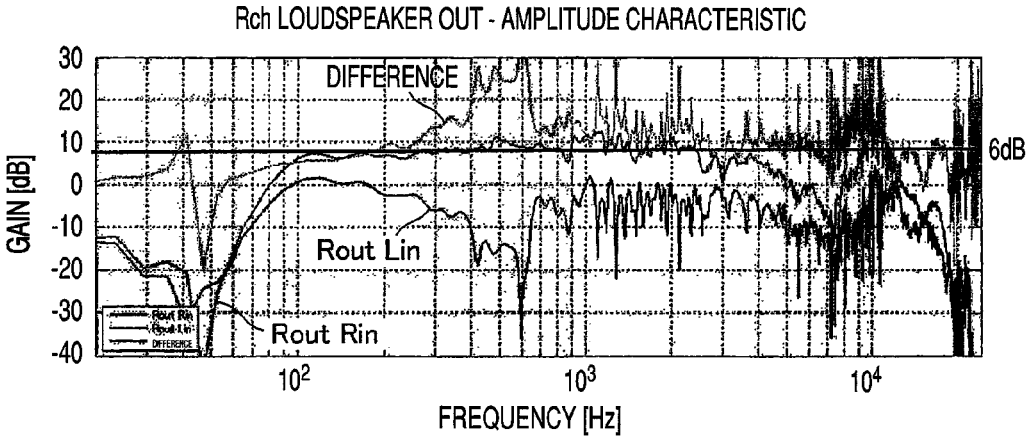
Figure 5A:
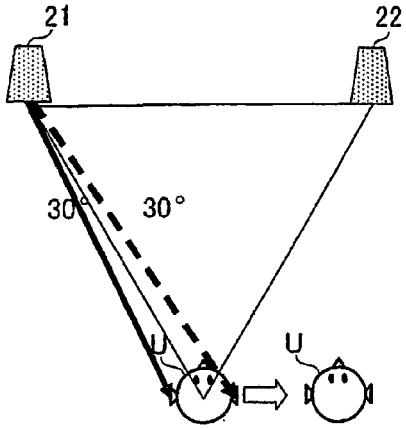
FIGS. 5A to 5C show a measurement result when a listening position is moved toward a right loudspeaker before a listening position is corrected.
Figure 5B:
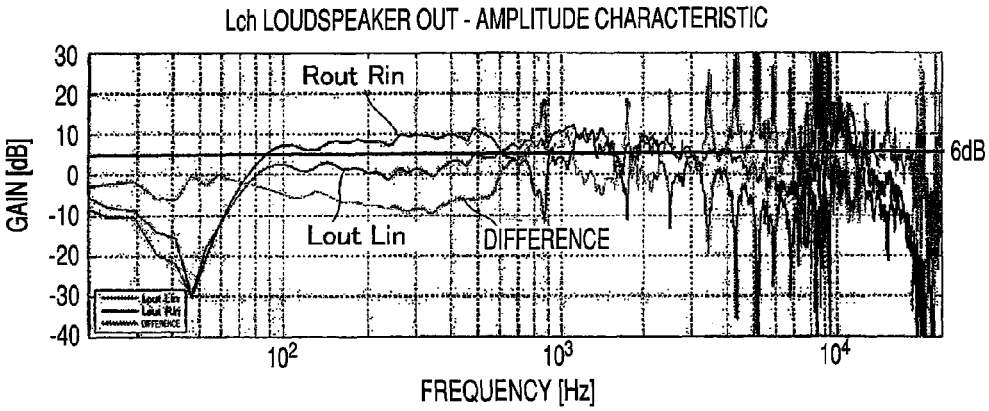
Figure 5C:
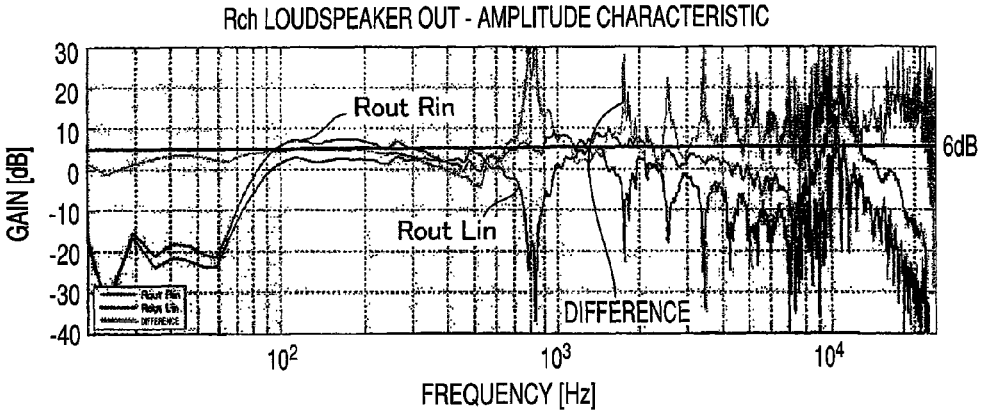
Figure 6A:
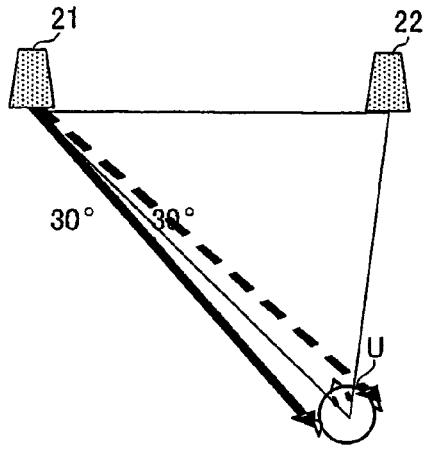
FIGS. 6A to 6C show a measurement result when a listening position is moved toward a right loudspeaker after a listening position is corrected.
Figure 6B:
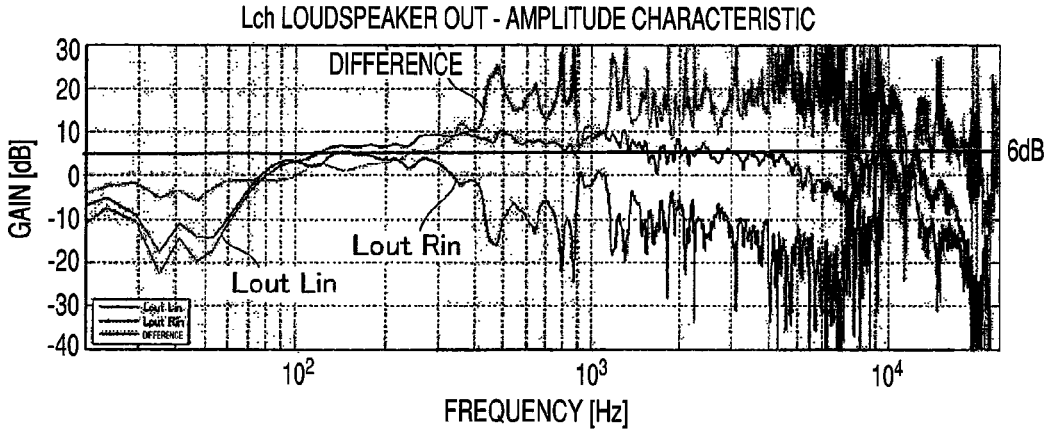
Figure 6C:
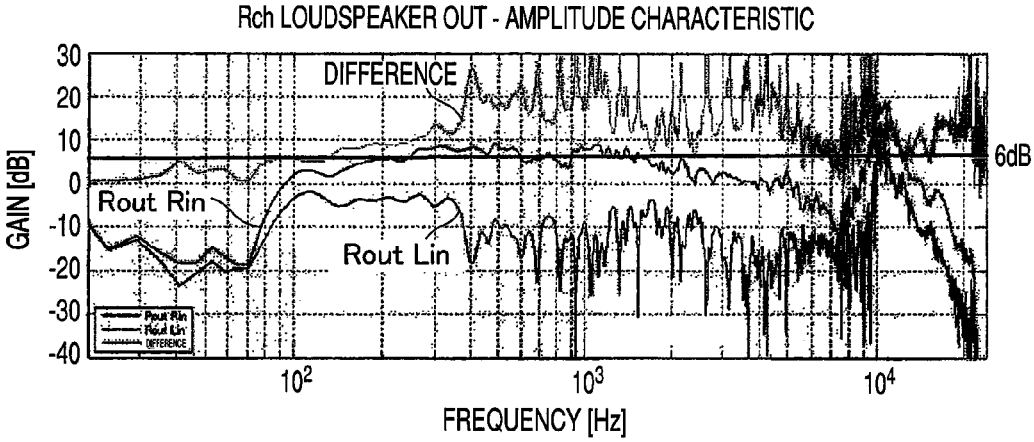

Next, a measurement result of crosstalk cancellation by the localization apparatus 1 will be described. FIGS. 4A to 4C show a measurement result when a listening position is set at a center of two loudspeakers. FIGS. 5A to 5C show a measurement result when a listening position is moved toward a right loudspeaker before a listening position is corrected. FIGS. 6A to 6C show a measurement result when a listening position is moved toward a right loudspeaker after a listening position is corrected. FIGS. 4A, 5A, and 6A show the relationship between two loudspeakers and a listening position, FIGS. 4B, 5B, and 6B show frequency characteristic diagrams of an Lch loudspeaker, and FIGS. 4C, 5C, and 6C are frequency characteristic diagrams of an Rch loudspeaker. In these drawings, frequency characteristics of a frequency band of 20 Hz to 20 kHz are shown. The frequency characteristics shown in FIGS. 4A to 6C are collected by a dummy head. In the localization apparatus 1, head related transfer functions corresponding to a head shape different from the dummy head used for sound collection.

As shown in FIGS. 4A to 4C, in case of general crosstalk cancellation when a listening position is set at the center of the two loudspeakers, for Lch and Rch, crosstalk cancellation of 6 dB or more is ensured even in a frequency band of 300 Hz or more.

In general, crosstalk cancellation is effectively performed if a level difference between a direct path and an indirect path is 6 dB. Therefore, it can be seen that crosstalk cancellation is favorably performed.

Meanwhile, as shown in FIGS. 5A to 5C, when the listening position is moved toward the right loudspeaker, and correction is not performed, crosstalk cancellation is 6 dB or less even in a frequency band of 300 Hz or more. Therefore, it can be seen that crosstalk cancellation is not favorably performed.

In contrast, as shown in FIGS. 6A to 6C, when the listening position is moved toward the right loudspeaker, and the listening position is corrected, like the FIGS. 4A to 4C, crosstalk cancellation of 6 dB or more is ensured even in a frequency band of 300 Hz. Therefore, it can be seen that crosstalk cancellation is favorably performed.

As described above, in the virtual sound source localization apparatus of this embodiment, as the head related transfer functions used in the SLch localization adder 42 and the SRch localization adder 46, the head related transfer functions corresponding to a head shape different from the dummy head used for sound collection. In addition, if only the volume level and the delay amount are corrected, without correcting the frequency characteristics of sounds emitted from the two loudspeakers 21 and 22, as shown in FIGS. 6A to 6C, crosstalk cancellation can be favorably performed.

Second Embodiment

Figure 7B:
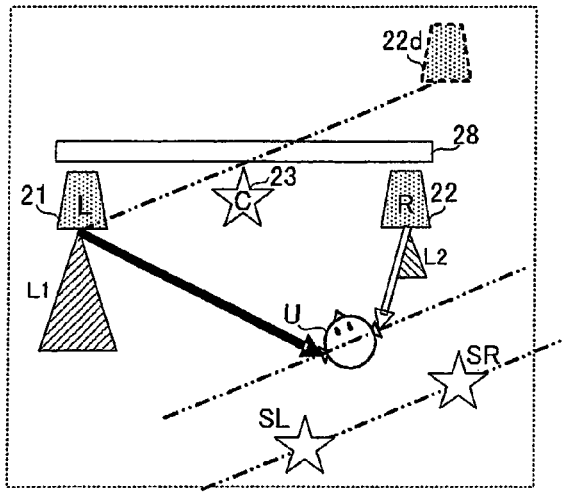
FIG. 7B is a diagram illustrating a virtual surround effect.
Figure 7A:
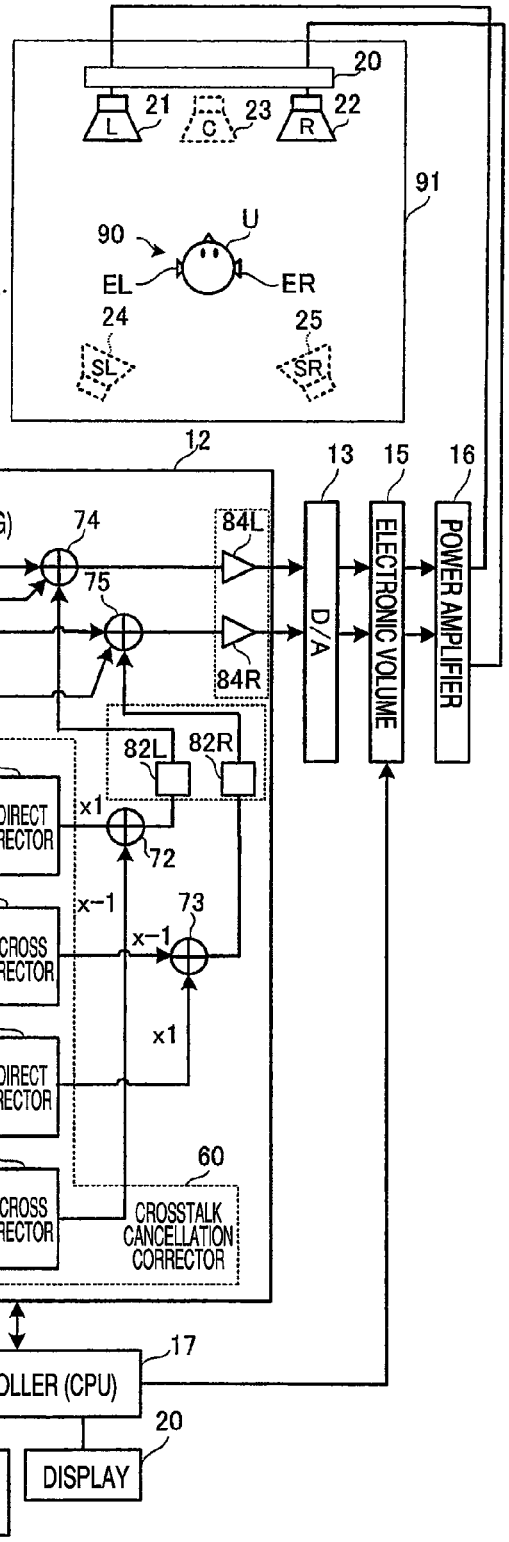
FIG. 7A is a block diagram showing the structure in which delay correctors are provided at positions different from those in the localization apparatus of in FIG. 1.
Figure 8B:
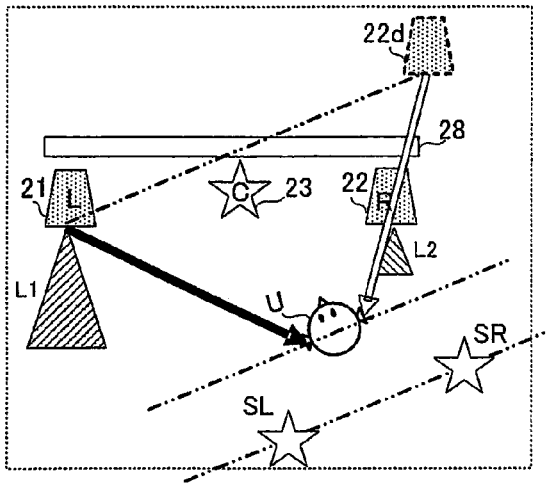
FIG. 8B is a diagram illustrating a virtual surround effect.
Figure 8A:
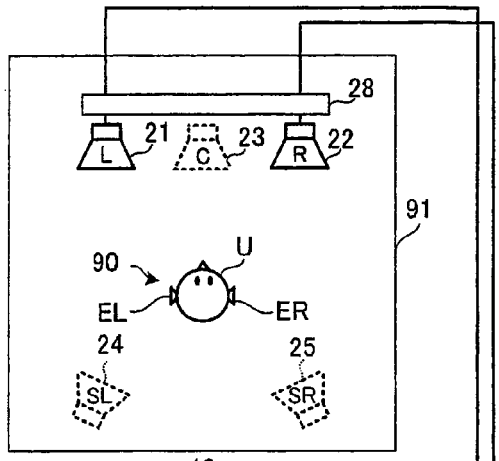
FIG. 8A is a block diagram showing the structure in which delay correctors are provided at positions different from those in the localization apparatus of in FIG. 1 or 7A.
Figure 8A:
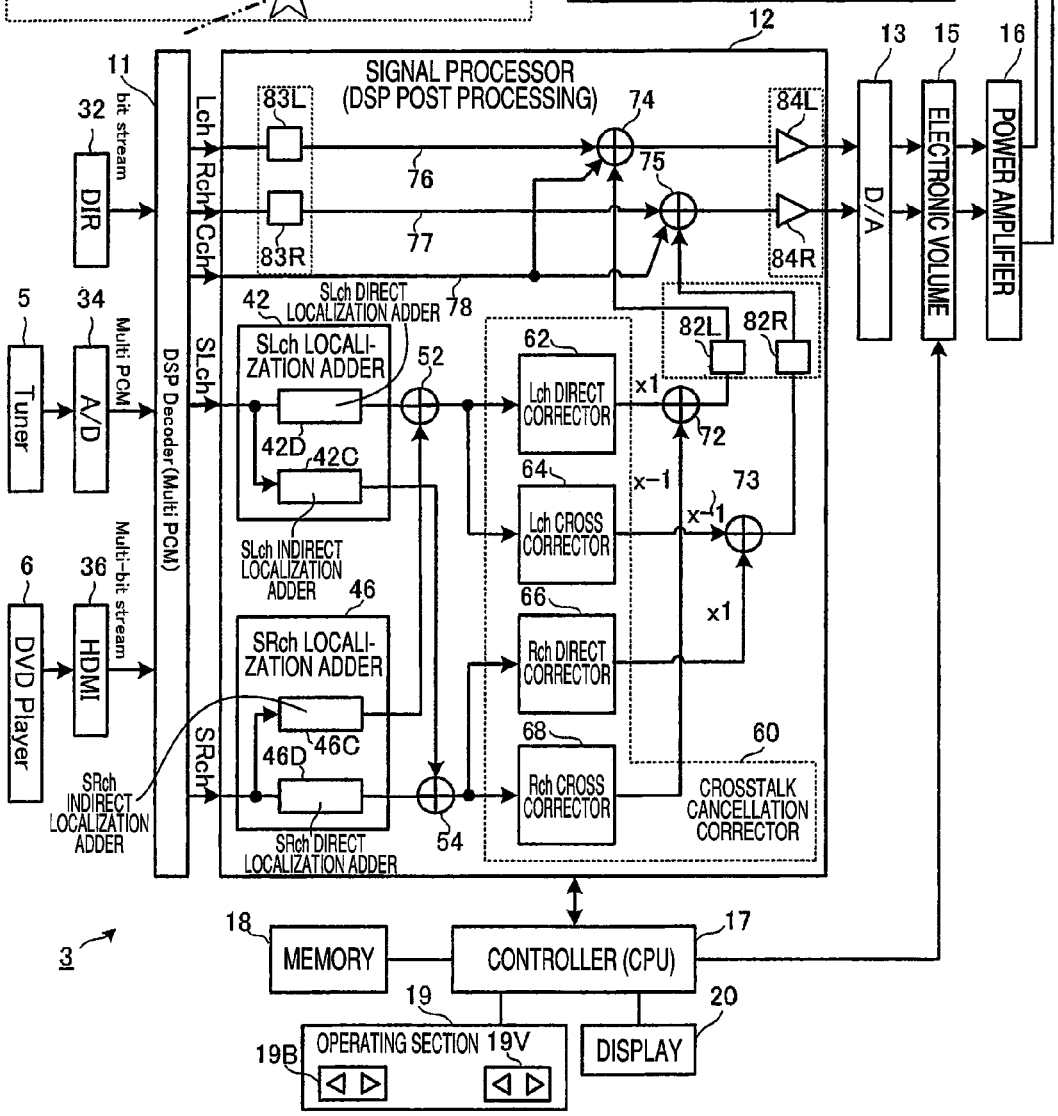

Next, a virtual sound source localization apparatus having a structure different from the localization apparatus 1 shown in FIG. 1 will be described. FIG. 7A is a block diagram showing the structure of a localization apparatus in which delay correctors are provided at positions different from those in the localization apparatus of FIG. 1. FIG. 7B is a diagram illustrating a virtual surround effect. FIG. 8A a block diagram showing the structure of a localization apparatus in which delay correctors are provided at positions different from those in the localization apparatus of FIG. 1 or 7A. FIG. 8B is a diagram illustrating a virtual surround effect.

In a localization apparatus 2 shown in FIG. 7, delay correctors 82L and 82R are provided between the adders 72 and 73 and the adders 74 and 75, respectively, at the rear of the adders 74 and 75. Other parts are the same as those in the localization apparatus 1. For this reason, a description will be provided focusing on a difference.

In the localization apparatus 2, the delay corrector 82L and 82R are provided at the rear of the crosstalk cancellation corrector 60. With this structure, the audio signals of the rear channels are subjected to crosstalk cancellation by the crosstalk cancellation corrector 60, delayed, and are then added to different audio signals. Therefore, the audio signals of all the channels are balance-adjusted. The listener U turns his/her face toward the center of the monitor 28 in order to view video or image displayed on the screen of the monitor 28. For this reason, if the listener U changes the listening position, and as described with reference to FIGS. 2A to 2H, correction is performed, a timing at which sounds emitted from the two loudspeakers reach the new listening position is changed to the same as a timing at which sounds emitted from the two loudspeakers reach the default listening position. That is, as shown in FIG. 7B, as described with reference to FIGS. 2A to 2H, the listener U at the listening position 90*n* listens to SLch and SRch sounds as if they are emitted from the Lch loudspeaker 21 and an Rch loudspeaker 22*d* indicated by a dotted line in FIG. 7B. For this reason, the localized positions of the SLch and SRch virtual sound sources 24 and 25 are corrected and virtually localized at the rear-left and rear-right positions of the listener U, similarly to virtual sound source localization shown in FIG. 2G. Meanwhile, since the Lch, Rch, and Cch audio signals are not delayed, the two loudspeakers 21 and 22 become the Lch and Rch sound sources, and thus the Cch sound image 23 is localized at the approximately center of the two loudspeakers 21 and 22.

As such, in the localization apparatus 2, only the sound sources of the rear channels subject to crosstalk cancellation can be virtually localized, and the sound sources of other channels not subject to crosstalk cancellation can be localized at the two loudspeakers or the center of the two loudspeakers. Therefore, the sound sources of channels other than the rear channels can be localized on the monitor 28 or a near side of the monitor 28, not on a depth side of the monitor 28.

Third Embodiment

Next, a localization apparatus in which different delay correctors are provided will be described. A localization apparatus 3 shown in FIG. 8A is different from the localization apparatus 2 in that delay correctors 83L and 83R are provided on Lch and Rch input signal lines 76 and 77 in front of the adders 74 and 75, respectively. Other parts are the same as those in the localization apparatus 2. For this reason, a description will be provided focusing on a difference.

In the localization apparatus 3, the delay correctors 82L, 82R, 83L, and 83R are provided at the rear of the crosstalk cancellation corrector 60 and on the Lch and Rch input signal lines 76 and 77 in front of the adders 74 and 75, respectively. In the localization apparatus 3, if the balance adjusting button 19B of the operating section 19 is operated, the controller 17 calculates the distance difference df between the two loudspeakers according to the procedure described with reference to FIGS. 3A and 3B, and also obtains the delay difference. The delay correctors 82L and 82R and the delay correctors 83L and 83R are adjusted on the basis of the obtained delay difference. With this structure, the audio signals of the rear channels are subjected to crosstalk cancellation by the crosstalk cancellation corrector 60 and the audio signals of the front channels are delayed, and are then added to other audio signals. Therefore, the audio signals of all the channels are balance-adjusted. The listener U turns his/her face toward to the center of the monitor 28 in order to view video or image displayed on the screen of the monitor 28. For this reason, if the listener changes the listening position, and as described with reference to FIGS. 2A to 2H, correction is performed, a timing at which sounds emitted from the two loudspeakers reach the new listening position is changed to the same as a timing at which sounds emitted from the two loudspeakers reach the default listening position. That is, as shown in FIG. 8B, the listener U at the listening position 90*n* listens to sounds as if the loudspeaker 22 close to the listener U from among the two loudspeakers 21 and 22 is localized as the Rch loudspeaker 22*d*, indicated by the dotted line, at the same distance as the loudspeaker 21 far from the listener U. The Cch sound image 23 is not delayed, and thus it is localized at the approximately center of the Lch loudspeaker 21 and the Rch loudspeaker 22. The SLch and SRch virtual sound sources 24 and 25 are localized at rear-left and rear-right positions of the listener U where a line connecting the virtual sound sources 24 and 25 is substantially parallel to a line connecting the Lch loudspeaker 21 and the Rch virtual loudspeaker 22*d*. Therefore, at the listening position 90*n*, the listener U can feel the surround sense.

As such, in the localization apparatus 3, the sound sources of the rear channels subject to crosstalk cancellation are virtually localized, and delay is performed as if the Rch virtual loudspeaker 22*d* is localized on a depth side of the Rch loudspeaker 22. Therefore, the audio signals of the channels other than the center channel are delayed and balance-adjusted, and thus the entire sound field excluding the center channel can be moved in accordance with the listening position. The sound source of the center channel can be localized on the monitor 28 or a near side of the monitor 28, not on a depth side of the monitor 28.

As described in the first to third embodiments, a change in position of the delay correctors enables selection of a localization position of a sound source to be corrected for any of the multi-channel sound. In addition, the delay correctors 81L, 81R, 82L, 82R, 83L, and 83R may be provided in a single localization apparatus, and the listener U may operate the operating section 19 to selectively function the same delay correctors as those in one of the localization apparatuses 1 to 3. In this case, the localization of the sound sources may be changed in accordance with the preference of the listener U.

[Others]

When a system is formed of one of localization apparatuses 1 to 3 and the monitor 28, the distance D between the loudspeakers 21 and 22 is substantially identical to the horizontal width of the monitor 28, which is provided along with one of the localization apparatuses 1 to 3, and the listening distance H is determined by the optimum viewing distance of the monitor 28 (the shortest distance between the line connecting the two loudspeakers and the listening position). For this reason, in the case of the system having one of the localization apparatuses 1 to 3 and the monitor 28, the monitor size (inches), the horizontal width of the monitor, and the optimum viewing distance of the monitor may be stored in the memory 18 beforehand in association with each other. When such a system is installed, the monitor size may be input by using the operating section 19. Therefore, during the optimization processing of the virtual surround effect, the controller 17 can read out the horizontal width of the monitor as the distance D between the loudspeakers 21 and 22 and the optimum viewing distance of the monitor as the listening distance H from the memory 18, and can perform the above-described adjustment.

In case of a unit in which the monitor size and the distance between the two loudspeakers are fixed, if the values are set in advance, it is unnecessary to input the monitor size.

As described above, in the virtual sound source localization apparatus of the invention, a position detection unit for detecting the position of the listener or a plurality of sound image localization coefficients are not needed. The correction of the levels (balance) of the audio signals and the delay amount in accordance with the listening position of the listener ensures adjustment of the localized positions of the virtual sound sources, without needing correction of frequency characteristics in accordance with an angle of the listening position with respect to the two loudspeakers. As a result, the listener can feel the surround sense.

In the foregoing description, an example where SLch and SRch are localized as the virtual sound sources has been described, but the invention is not limited thereto. For example, other channels, such as Lch, Rch, and the like, may be localized as the virtual sound sources.

In the foregoing description, a case where the listener operates the balance adjusting button 19B of the operating section 19 to localize the sound image 23 of the center channel at the approximately center of the two loudspeakers has been described. Alternatively, when the center channel is not included in the multi-channel audio signal, a sound image, which is desired at a center, for example, a sound image, such as a voice of an announcer in a news program or a vocalist of a band, may be localized at the approximately center of the two loudspeakers 21 and 22.

What is claimed is:

1. A virtual sound source localization apparatus that receives input multi-channel audio signals of video/sound contents and supplies output multi-channel audio signals to two loudspeakers for emitting sound of the video/sound contents, wherein the two loudspeakers are arranged at front-left and front-right positions, respectively, with respect to a default listening position, to thereby localize virtual sound sources around a listener at the default listening position, the apparatus comprising:

a virtual localization imparting unit that calculates transfer characteristics of sound that reaches ears of the listener at the default listening position from a virtually localized position around the default listening position on the basis of predetermined head related transfer functions, and imparts the transfer characteristics to audio signals of one or more channels which are to be localized as the virtual sound source among the input multi-channel audio signals, wherein the virtual localization imparting unit outputs transfer characterized audio signals;

a crosstalk cancellation unit that performs crosstalk cancellation on the transfer characterized audio signals to cancel crosstalk to the listener at the default listening position, wherein the crosstalk cancellation unit outputs crosstalk cancelled audio signals;

a balance adjusting unit that performs balance adjustment;

a first delay unit that performs delay processing; and a controller that receives an operation from an operating unit to localize a sound image, which is desired to be localized at an approximate center of the two loudspeakers at a new listening position different from the default listening position, wherein:

the controller calculates signal levels for the output multi-channel audio signals to be supplied to the two loudspeakers, respectively, in accordance with the operation received by the operating unit to set sound of the sound image emitted from the two loudspeakers to be at the same volume level at the new listening position, the controller calculates a difference in distance from the two loudspeakers to the new listening position by using the calculated signal levels for the output multi-channel audio signals, and calculates a delay amount by which at least a timing to supply the crosstalk cancelled audio signals to the two loudspeakers on the basis of the difference in distance is delayed in order to change a timing at which sounds emitted from the two loudspeakers reach the new listening position, to the same as a timing at which sounds emitted from the two loudspeakers reach the default listening position, the controller causes the balance adjusting unit to perform balance adjustment on the input multi-channel audio signals in accordance with the calculated signal levels for the output multi-channel audio signals, and causes the first delay unit to perform delay processing at least on the crosstalk cancelled audio signals by the calculated delay amount, and the virtual sound source localization apparatus outputs the output multi-channel audio signals including processing results of the balance adjusting unit and the first delay unit.

2. The apparatus according to claim 1, further comprising:

an adding unit that, for each of the multi-channel audio signals, adds the crosstalk cancelled audio signals and non-crosstalk cancelled audio signals which are not subjected to the crosstalk cancellation, wherein the adding unit outputs an added audio signal, and wherein the first delay unit delays the added audio signal.

3. The apparatus according to claim 1, further comprising:

an adding unit that is provided between the first delay unit and the balance adjusting unit, and adds, for each of the multi-channel audio signals, the crosstalk cancelled audio signals and non-crosstalk cancelled audio signals which are not subjected to the crosstalk cancellation, wherein the adding unit outputs an added audio signal, and wherein the balance adjusting unit performs the balance adjustment on the added audio signal.

4. The apparatus according to claim 3, wherein the non-crosstalk cancellation audio signals which are not subjected to the crosstalk cancellation contain a front-channel audio signal, and the apparatus further includes:

a second delay unit that is controlled by the controller and delays a sound output timing to supply the front-channel audio signals to the two loudspeakers on the basis of the difference in distance calculated by the controller in order to cause sound based on the front-channel audio signals to be emitted from the virtually localized two loudspeakers.

5. The apparatus according to claim 1, further comprising:

an input unit that, as data to be used to calculate the difference in distance from the two loudspeakers to the new listening position, receives an input of information regarding a distance between the two loudspeakers and a shortest distance between a line connecting the two loudspeakers and the listening position; and a storage unit that stores the information received by the input unit, wherein the controller calculates the difference in distance by using the information read out from the storage unit and a difference in output level between the two loudspeakers after the balance adjustment performed by the balance adjusting unit.

6. The apparatus according to claim 1, further comprising:

a monitor for displaying video of the video/sound contents, disposed between the two loudspeakers;

a size storage unit that stores a size of the monitor, a distance between the two loudspeakers set according to the size, and a shortest distance between a line connecting the two loudspeakers and the listening position; and a size input unit that receives an input of the size of the monitor, wherein the controller reads out information regarding the distance between the two loudspeakers according to the size of the monitor received by the size input unit and the shortest distance between the line connecting the two loudspeakers and the listening position from the size storage unit, and calculates the difference in distance from the two loudspeakers to the listening position by using the information regarding the distance between the two loudspeakers and a difference in output level between the two loudspeakers after the balance adjustment performed by the balance adjusting unit.

7. The apparatus according to claim 1, wherein the controller converts a signal level difference between the two loudspeakers after the balance adjustment by the balance adjusting unit into the difference in distance from the two loudspeakers to the listening position.

* * * * *